US008292133B2

(12) United States Patent
Baughman et al.

(10) Patent No.: US 8,292,133 B2
(45) Date of Patent: Oct. 23, 2012

(54) VENTED CLOSURE ASSEMBLY FOR A CONTAINER

(75) Inventors: Gary M. Baughman, Fremont, IN (US); Lynn A. Brooks, Auburn, IN (US)

(73) Assignee: Rieke Corporation, Auburn, IN (US)

( * ) Notice: Subject to any disclaimer, the term of this patent is extended or adjusted under 35 U.S.C. 154(b) by 534 days.

(21) Appl. No.: 12/611,211

(22) Filed: Nov. 3, 2009

(65) Prior Publication Data

US 2010/0282783 A1 Nov. 11, 2010

Related U.S. Application Data

(60) Provisional application No. 61/176,213, filed on May 7, 2009.

(51) Int. Cl.
*B67D 3/00* (2006.01)

(52) U.S. Cl. ..... 222/529; 222/541.9; 222/530

(58) Field of Classification Search ..... 222/526–530, 222/541.9

See application file for complete search history.

(56) References Cited

U.S. PATENT DOCUMENTS

| | | | | |
|---|---|---|---|---|
| 2,561,596 A | | 7/1951 | Rieke | 222/527 |
| 2,898,018 A | | 8/1959 | Borah | 222/529 |
| 3,604,740 A | | 9/1971 | Summers | 292/256.61 |
| 3,613,966 A | * | 10/1971 | Summers | 222/529 |
| 4,236,629 A | | 12/1980 | Dwinell | 222/529 |
| 4,294,382 A | | 10/1981 | Summers et al. | 222/529 |
| 4,320,861 A | | 3/1982 | Rieke et al. | 222/541 |
| 4,555,048 A | | 11/1985 | Hamman et al. | 222/478 |
| 4,568,006 A | | 2/1986 | Mueller et al. | 222/488 |
| 4,618,078 A | * | 10/1986 | Hamman et al. | 222/478 |
| 4,632,282 A | | 12/1986 | Nagashima | 222/529 |
| 4,699,290 A | | 10/1987 | Adams | 220/258 |
| 4,718,553 A | | 1/1988 | Adamoli et al. | 206/459 |
| 4,801,031 A | | 1/1989 | Barriac | 215/252 |
| 4,805,791 A | | 2/1989 | Begley | 215/252 |
| 4,877,143 A | | 10/1989 | Travisano | 215/230 |
| 4,921,147 A | | 5/1990 | Poirier | 222/527 |
| 4,981,230 A | | 1/1991 | Marshall et al. | 215/252 |

(Continued)

FOREIGN PATENT DOCUMENTS

DE 38 05 648 A1 9/1989

(Continued)

OTHER PUBLICATIONS

Search Report from EP 09252748.0, dated Jul. 13, 2010, 4 pgs.

(Continued)

*Primary Examiner* — Kevin P Shaver
*Assistant Examiner* — Andrew P Bainbridge
(74) *Attorney, Agent, or Firm* — Woodard Emhardt Moriarty McNett & Henry LLP

(57) ABSTRACT

A vented closure assembly for a container, the container including a raised outlet defining a dispensing opening, includes a closure body having a nestable and extendable spout formed with a generally cylindrical section, a frusto-conical section, and a transition region, including an invertible fold, located between these two sections. The generally cylindrical section defines an outlet opening and a threaded closing cap is assembled to the generally cylindrical section for closing off the outlet opening. A retainer is used for connecting the closure body to the raised outlet wall and the spout includes a thicker wall portion for enabling the closure body to maintain a selected orientation. A plurality of venting ears are used to help provide the venting capability.

14 Claims, 7 Drawing Sheets

U.S. PATENT DOCUMENTS

| | | | | |
|---|---|---|---|---|
| 5,035,341 | A | 7/1991 | Heilman et al. | 215/230 |
| 5,088,632 | A | 2/1992 | Odet et al. | 222/529 |
| 5,096,079 | A | 3/1992 | Odet | 215/252 |
| 5,230,442 | A * | 7/1993 | Dean, Jr. | 222/108 |
| 5,641,099 | A | 6/1997 | McLelland et al. | 222/530 |
| 5,722,570 | A * | 3/1998 | Sultzer et al. | 222/529 |
| 5,788,100 | A | 8/1998 | Sturk | 215/258 |
| 5,899,364 | A | 5/1999 | McLelland et al. | 222/153.06 |
| 5,967,376 | A | 10/1999 | McLelland et al. | 222/153.06 |
| 6,135,985 | A | 10/2000 | Fromer | 604/295 |
| 6,193,921 | B1 | 2/2001 | Nelson | 264/328.1 |
| 6,454,137 | B1 * | 9/2002 | Sturk | 222/189.09 |
| 6,641,007 | B2 | 11/2003 | Chung et al. | 222/529 |
| 6,712,246 | B2 | 3/2004 | Nobbio | 222/527 |
| 7,614,530 | B2 * | 11/2009 | Baughman et al. | 222/529 |
| 7,717,307 | B2 * | 5/2010 | Baughman et al. | 222/529 |
| 7,789,277 | B2 * | 9/2010 | Baughman et al. | 222/529 |
| 7,798,378 | B2 * | 9/2010 | Baughman et al. | 222/529 |
| 2005/0274815 | A1 | 12/2005 | Bergholtz et al. | 239/16 |
| 2008/0296301 | A1 | 12/2008 | Baughman et al. | 220/289 |

FOREIGN PATENT DOCUMENTS

| | | | |
|---|---|---|---|
| EP | 0 221 419 | A2 | 5/1987 |
| EP | 0 161 746 | B1 | 4/1989 |
| EP | 0 432 059 | B1 | 6/1993 |
| FR | 2 578 819 | A1 | 9/1986 |
| GB | 1 270 086 | | 4/1972 |
| GB | 2 055 722 | A | 3/1981 |
| GB | 2 121 374 | A | 12/1983 |
| WO | WO 00/34133 | A2 | 6/2000 |
| WO | WO 02/49931 | A1 | 6/2002 |

OTHER PUBLICATIONS

Search Report dated Jul. 24, 2008 from Singapore Patent Application No. 200704290-6, 9 pgs.

Search Reported dated Aug. 13, 2007 from European Patent Application No. 07252250.1-2308, 5 pgs.

* cited by examiner

VENTED CLOSURE ASSEMBLY FOR A CONTAINER

CROSS REFERENCES TO RELATED APPLICATIONS

The present application claims the benefit of U.S. Provisional Application No. 61/176,213, filed May 7, 2009, which is hereby incorporated by reference in its entirety.

BACKGROUND OF THE INVENTION

The present disclosure relates in general to container closures and closure assemblies which include, as one component, a nestable and extendable spout. More specifically, the present disclosure relates to the addition of venting ears that change orientation as the spout is extended. Also disclosed herein is the addition of a thicker material section to the wall of the spout such that the spout can be deflected and then set and retained in a desired orientation. Further disclosed features include the shape and styling of the threaded closing cap.

Container closures and closure assemblies of the type generally described herein often include some tamper-evident feature incorporating a plurality of frangible elements. One such product has been offered by Rieke Corporation of Auburn, Ind., under its FLEXSPOUT® trademark. This product includes a tamper-evident closing cap and a closure body with a nestable and extendable spout. Typically a tamper-evident closing cap threads onto the threaded end of the spout and the cap must be removed in order to gain access to the contents of the container (drum) via the interior of the spout. In one arrangement the closure body is received by a raised surrounding (annular) wall that defines the container opening and when used on a metal drum end, the closure includes an annular retaining member that fits over an outer wall portion of the closure body and, by crimping, secures the outer wall portion to the surrounding wall which defines the container opening. In other arrangements which are suitable for the closure assembly of the present invention, different styles of containers and openings are used. The closure assembly construction further includes a series of frangible elements that connect a pair of bail handles that are used to extend the spout with the remainder of the closing cap. When a plastic drum or container receives a FLEXSPOUT® closure, one style of tamper-evident cap includes an outer annular portion that snaps over an outer wall portion of the closure body and secures the outer wall portion to the surrounding wall that defines the container opening. A series of frangible elements connects the outer annular portion of the tamper-evident cap with the remainder of the cap body, principally with a pair of bail handles which are used to extend the spout.

One structural feature or characteristic that has been used with closures and closure assemblies of the general style being discussed herein is the use of a series of venting ears or venting tabs. One such example is disclosed in U.S. Pat. No. 4,618,078, issued Oct. 21, 1986 to Hamman, et al. A venting capability can also be provided by the use of an annular cup with a series of spaced-apart openings or slits. A still further style uses an annular ring with edge openings that extend below the spout. However, the focus of this disclosure is on the use of venting ears. As noted, these venting ears may also be referred to as venting tabs.

A further feature of the present invention is the addition of a thicker section of material as part of the extendable spout that provides a "memory band" feature for the spout. This "memory band" structure allows the extended spout to be flexed or bent in a desired direction and then stay there, in that selected orientation, until moved manually, to a new orientation. When a vented closure is used, see U.S. Pat. No. 4,618,078, issued Oct. 21, 1986 to Hamman et al. as one example of a vented closure, the flexing or bending of the spout in a desired direction provides an added benefit. The bending or flexing of the spout into the desired direction for discharge of the contents of the container puts into play only those venting ears that are advantageous to the actual dispensing and takes the other venting ears out of play. This in turn yields a larger dispensing opening and therefore a faster flow rate for the outflow or dispensing of product from the container. The outflow of fluid product from the drum or container is still smoother (as compared to a non-vented closure) due to the fact that some of the venting ears are still used. The venting ears which are in play when the extended spout is flexed provide an adequate path and sufficient flow area for air based upon the exiting flow rate. Depending on the size and number of venting ears, it is possible for adjacent ears, once flipped to a generally horizontal orientation, to display some area of partial overlap, typically on the "corners" in the earlier designs. In the earlier spout constructions, when the ears "flip" their orientation from generally vertical to generally horizontal, the overlapping contact is not seen as a concern. However, with the use of the "memory band" feature, the deflection of the spout to a dispensing orientation causes further movement of the ears relative to each other and further overlapping contact of adjacent ears.

The present disclosure incorporates a design change to the earlier vented closures. This design change provides a plurality of venting ears wherein the width of each venting ear is less (i.e., more narrow) as compared to prior venting ears and the number of venting ears is increased compared to prior venting ears. In the '078 patent, as one example, there are eight (8) venting ears with overlapping corners once the spout is extended. In one embodiment of the present disclosure there are ten (10) more-narrow venting ears, without any overlap, and without any other noticeable contact, between adjacent ears when the spout is extended. With this new design there is also no overlap or any noticeable contact between adjacent venting ears as the spout is deflected into a dispensing orientation. The length of each venting ear is also a consideration relative to its point of joinder to the closure body and the flow opening to be defined by the inner ends or edges of each venting ear once the spout is extended.

BRIEF SUMMARY OF THE INVENTION

A vented closure assembly for a container, the container including a dispensing opening, includes a closure body including a nestable and extendable spout, the spout having a generally cylindrical section and a frustoconical section, and a transition region, including an invertible fold located between the two sections, the generally cylindrical section defining an outlet opening, and a tamper-evident closing cap constructed and arranged for assembly to the spout for closing off the outlet opening. The spout includes a wall section having a first wall thickness and a "memory band" portion with a second wall thickness that is greater than the first wall thickness, the memory band portion being constructed and arranged for enabling the spout to maintain a selected orientation upon deflecting the spout into the selected orientation for directional discharge of container contents. A plurality of venting ears are used to help to discharge and provide the venting capability.

One object of the present disclosure is to provide an improved vented closure assembly for a container.

Related objects and advantages of the present disclosure will be apparent from the following description.

DETAILED DESCRIPTION OF THE INVENTION

Figure 1:
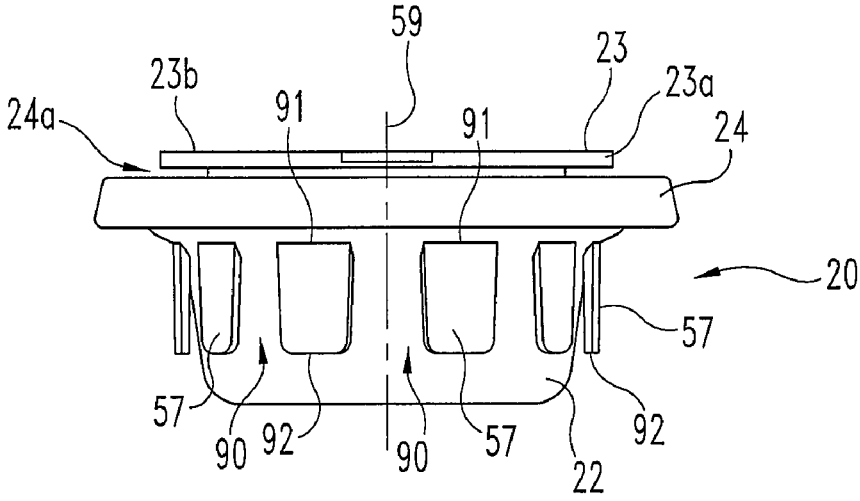
FIG. 1 is a front elevational view of a closure assembly as assembled and prior to attachment to the outlet of a container, according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
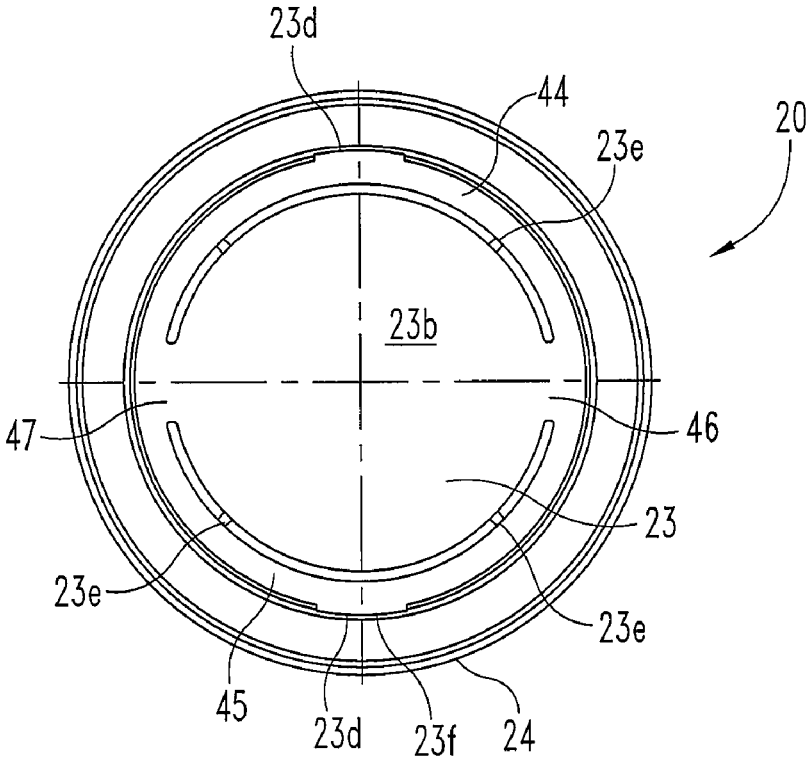
FIG. 2 is a top plan view of the FIG. 1 closure assembly.
Figure 3:
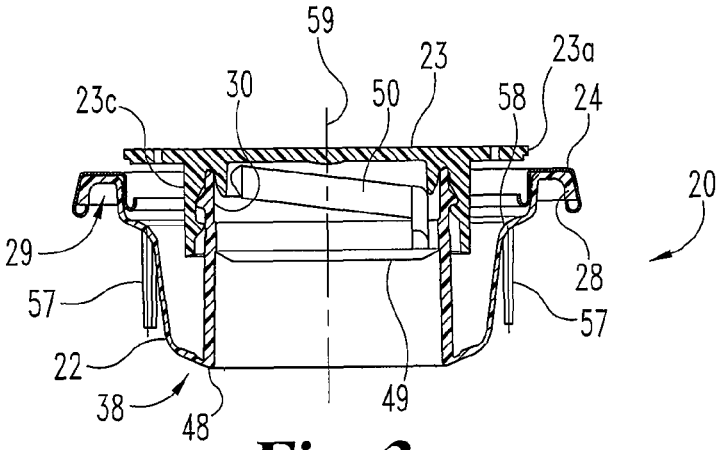
FIG. 3 is a front elevational view, in full section, of the FIG. 1 closure assembly.
Figure 4:
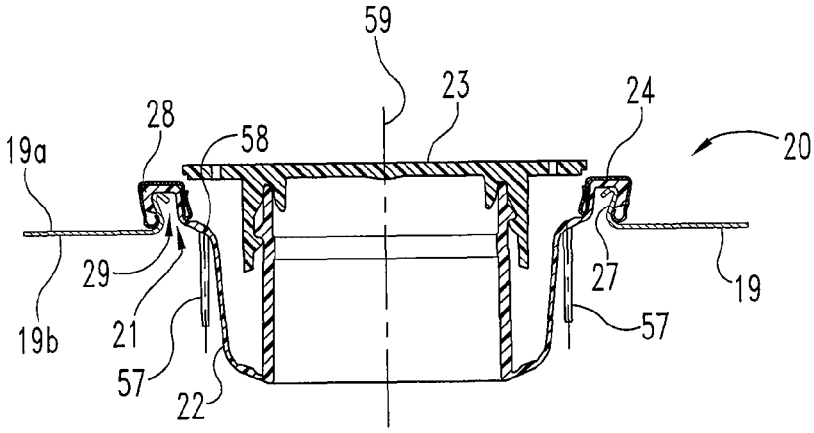
FIG. 4 is a front elevational view, in full section, of the FIG. 1 closure assembly in a nested orientation, as attached to the outlet opening of a container.
Figure 5:
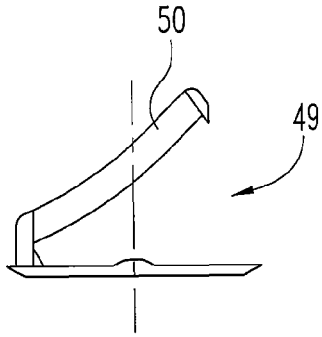
FIG. 5 is a front elevational view of a diaphragm as removed from the FIG. 1 closure assembly.

Referring to FIGS. 1-7, there is illustrated a generic closure assembly 20 according to the present disclosure. Closure assembly 20 is constructed and arranged for secure connection to or into an outlet opening defining structure whether a raised annular outlet wall or a container opening edge or some other opening configuration. The defined outlet opening is positioned within the end panel 19*b* of a corresponding container or drum 19. The upper surface 19*a* of the end panel 19*b* of container 19 is planar and surrounds the raised annular outlet wall or container opening, depending on the particular construction. The raised outlet wall defining the outlet opening of a metal drum end is illustrated in FIG. 4. The closure assembly 20 can also be used with a plastic drum or pail.

FIGS. 1-3 show the form of closure assembly 20 as it would be sold to a drum or pail manufacturer or filler. FIG. 4 illustrates the manner of attaching the closure assembly 20 to the raised opening of a container or drum 19. In this illustration, the removable (pull to tear out) diaphragm (see FIG. 5) has been removed. Access to the diaphragm, and ultimately to the contents of the drum or other container, is gained by unthreading removal of the closing cap. The extended orientation of FIGS. 6 and 7 shows the undeflected form of the spout and the relationship of the venting ears to each other prior to any deflection of the spout.

The drawing illustrations of FIGS. 1-7 depict what has been described as a "generic" closure assembly 20 based on this disclosure. While the present disclosure is directed to three embodiments for the closure assembly, the general construction and appearance, components parts, and initial movement to the extended orientation of all three embodiments, as disclosed herein, are essentially the same. The differences between these three embodiments are limited to the number and location of a thicker spout wall portion or section that provides a unique spout deflection capability. These differences between the three embodiments will be described and explained relative to FIGS. 8A-10B. First though, the details of the (generic) closure assembly 20 will be described.

Figure 6:
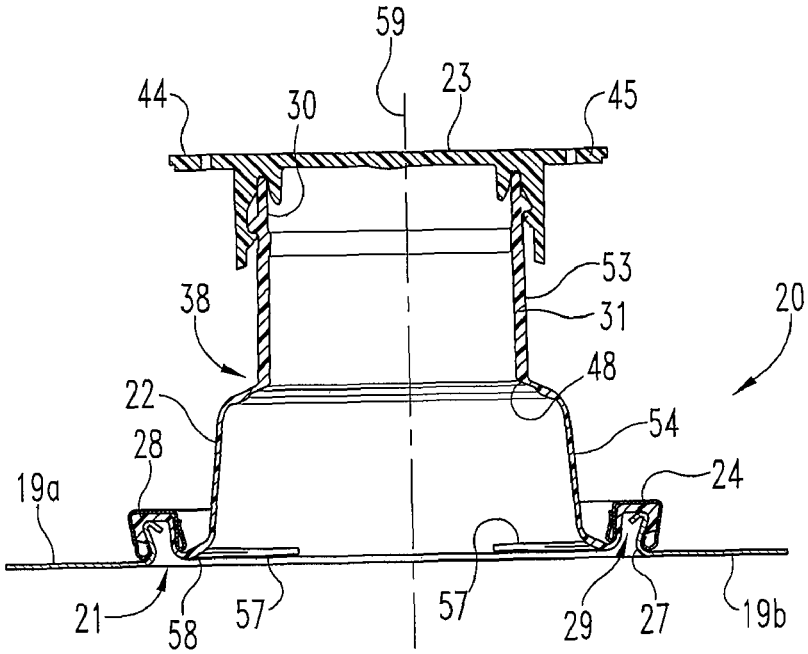
FIG. 6 is a front elevational view, in full section, of the FIG. 1 closure assembly in an extended orientation.
Figure 7:
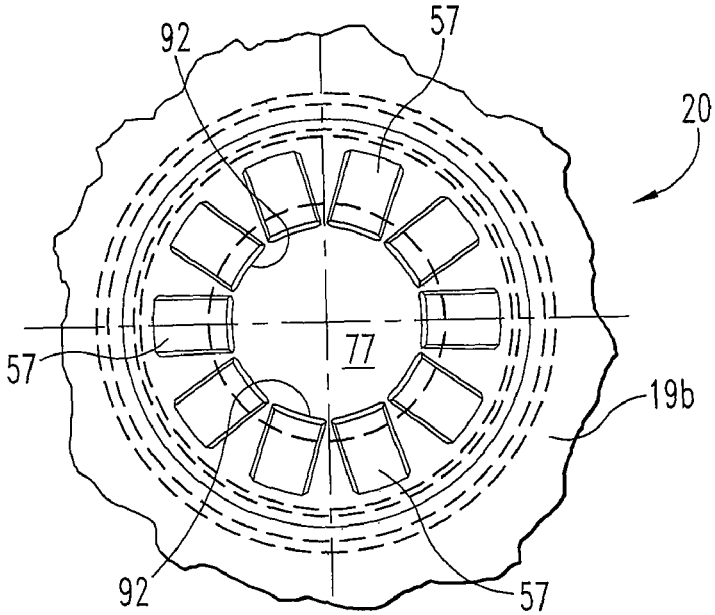
FIG. 7 is a bottom plan view of the FIG. 1 closure assembly in the FIG. 6 extended orientation.

Referring to FIGS. 1-7, closure assembly 20 includes a closure body 22, tamper-evident closing cap 23, and annular metal retainer 24. Each of these three component parts constitutes a unitary component with the closure body 22 being molded out of plastic, the tamper-evident closing cap 23 being molded out of plastic, and the retainer 24 being formed as a unitary component out of metal. The details of the closure body 22 are illustrated in FIGS. 6 and 7. Some of the structural details of the closing cap 23 and retainer 24 are further described in U.S. application Ser. No. 11/423,630, Filed Jun. 12, 2006, entitled A CLOSURE ASSEMBLY HAVING A SPOUT WITH A MEMORY BAND FOR SPOUT DIRECTING, which application is hereby incorporated by reference, in its entirety. However, there are closing cap design changes made to closing cap 23 which are not part of the closing cap disclosed in the '630 application. As illustrated in FIGS. 1-3, the closure assembly 20 is constructed and arranged to be preassembled, as illustrated, and then applied to the raised outlet wall of the container end panel 19*b* for crimping of the retainer 24 so as to anchor the closure body 22 to the outlet wall.

With continued reference to FIGS. 1-7, and considering the prior remarks, it will be seen that closure assembly 20 assembles onto the formed and raised outlet wall 27 that defines outlet opening 21. The closure body 22 includes an annular outlet lip 28 formed with an inverted annular channel 29. The annular channel 29 fits over and around outlet wall 27, see FIGS. 4 and 6. Once the closure body 22 and outlet wall 27 are assembled in this manner, noting that the annular metal retainer 24 is preassembled to the closure body, this positions the metal retainer 24 over and around the outer lip 28. The next step is to crimp the metal retainer 24 so as to securely and tightly clamp the outer lip 28 onto and around the outlet wall 27, creating a sealed interface and a secure annular connection.

The tamper-evident closing cap 23 is internally threaded and the dispensing end 30 of the nestable and extendable spout 31 of closure body 22 is externally threaded for receipt of the closing cap 23. The closing cap 23 can be threaded onto spout 31 either before or after the closure body is crimped onto outlet wall 27 by the use of metal retainer 24. However, in terms of an initial subassembly of closure assembly 20 with its three component parts, the metal retainer 24 would be preassembled onto the closure body 22, see FIGS. 1 and 2.

Closure body 22 includes a transition region 38 with an invertible fold 48 that reverses its orientation when changing the closure body from a nested orientation (see FIG. 1) to an extended orientation (see FIGS. 6 and 7). Closure body 22 also includes a tear-out diaphragm 49 with a unitary pull ring 50. A weakened annular score line or an annular severable membrane surrounds the diaphragm 49 and connects the outer edge of the diaphragm to the inner surface of the spout 31. The pull ring 50 is joined to one edge portion of diaphragm 49 and by pulling upwardly on ring 50, the diaphragm 49 is able to be torn out of the interior of spout 31. This tearing out is accomplished by causing the annular score line (or membrane) to sever. As an alternative to the use of pull ring 50, this diaphragm could be cut free from its unitary connection with spout 31. However, the use of pull ring 50 is believed to be preferred and, due to the weakened score line or membrane, continued pulling on ring 50 causes the entire diaphragm 49 to separate from within spout 31. The unitary molding of closure assembly 20 includes the unitary construction of pull ring 50 and diaphragm 49.

The spout 31 can be considered as having three sections or portions including an inner, generally cylindrical section 53, an outer, frustoconical section 54, and a transition region or portion 38 therebetween. The transition region 38 includes the invertible fold 48. The outer section 54 includes a series of venting ears 57 that are positioned at fold 58 and arranged in an annular array, substantially equally spaced apart. Each venting ear depends in an axially downward direction when the closure body 22 is in its nested orientation. When the closure body 22, specifically the spout 31, is extended, the fold 58 moves and flips the venting ears 57 into a lateral or generally horizontal orientation, see FIGS. 6 and 7. All of the venting ears are in a generally horizontal orientation when the spout is extended (axially) and not flexed or deflected. The orientations of at least some of the individual venting ears will be different when the spout is deflected. In terms of the directions referenced herein, FIGS. 1, 2, 4 and 6 represent the typical, upright orientation and centerline 59 represents the longitudinal axis through the geometric center of the closure assembly 20. As used herein, an axial direction is generally parallel to centerline 59 and a lateral direction is generally perpendicular to centerline 59.

Closing cap 23 includes, as part of its unitary, molded plastic construction, a pair of oppositely-disposed bail handles 44 and 45. Each bail handle 44 and 45 is joined to the remainder of the closing cap 23 by living hinges. As initially configured, prior to any opening of the closure assembly, the bail handles 44 and 45 lay substantially flat (planar) and the geometric plane in which they lay is substantially parallel with the planar upper surface 19*a* of the container end. In use, whether or not the bail handles 44 and 45 are each secured in a down and flush orientation by a frangible element, the living hinge and the initially molded condition positions the bail handles down and generally flush with the upper surface of the tamper-evident closing cap 23. The planar orientation of the two bail handles positions them in a geometric plane that is substantially parallel with upper surface 19*a*. However, when the bail handles are lifted as the preferred way to remove the closing cap 23 and/or extend spout 31, the living hinges experience a slight plastic deformation. This causes the bail handles 44 and 45 to remain slightly raised after the initial lifting.

Closing cap 23 includes a low-profile, substantially planar upper lip 23*a* which comprises the top panel 23*b* of the threaded cap body 23*c* and includes bail handles 44 and 45, living hinge portions 46 and 47, a pair of lift tabs 23*d*, and the referenced frangible elements 23*e*. The two living hinge portions 46 and 47 are generally spaced 180 degrees apart. The two lift tabs 23*d* are also generally spaced 180 degrees apart and are further spaced generally equidistant (circumferentially) from the hinge portions. One frangible element 23*e* is positioned between each hinge portion—lift tab pair.

The substantially parallel construction of upper lip 23*a* relative to upper surface 19*a* of the end panel in cooperation with the construction and arrangement of retainer 24 creates a clearance space 24*a* below the lower surface of lip 23*a*. This clearance space 24*a* has a substantially uniform spacing and provides access to the underside of each lift tab 23*d* (typically with a fingertip/nail of the user) so as to begin the process of lifting each bail handle 44 and 45. The outermost edge 23*f* of each lift tab 23*d* is slightly spaced from the inner, generally circular edge of retainer 24 to further facilitate the process of lifting each bail handle 44 and 45.

This low-profile cap construction and the lift tab construction create an aesthetically clean, trim, and sleek appearance for closing cap 23. The clearance spaces and separation as described above of the closure cap relative to retainer 24 enable the user to readily and easily gain access to the underside of each lift tab for beginning the lifting of each bail handle. This initial bail handle lifting is what causes the frangible elements 23*e* to fracture. Thereafter, the bail handles can be lifted to a higher elevation pivoting about the two living hinge portions 46 and 47 so as to permit a more complete grasping by the hand/fingers of the user so as to lift the spout to an extended orientation.

As previously explained, the closure assembly 20 is intended to represent a generic form of closure assembly as a way to describe the basic construction of the closure body 22, closing cap 23, and retainer 24. However, the three other (primary) embodiments, identified as closure assemblies 120, 220, and 320, differ from one another in the number and location of thicker wall sections or portions that provide a suitable structure for deflection of the spout and for retaining the deflected spout in the desired or selected orientation. These thicker wall sections or portions are also referenced as thicker bands or "memory band" portions. This terminology comes from the branding used for the product source of origin. This product branding uses the trademark phrase "MEMORY BAND".

Figure 12:
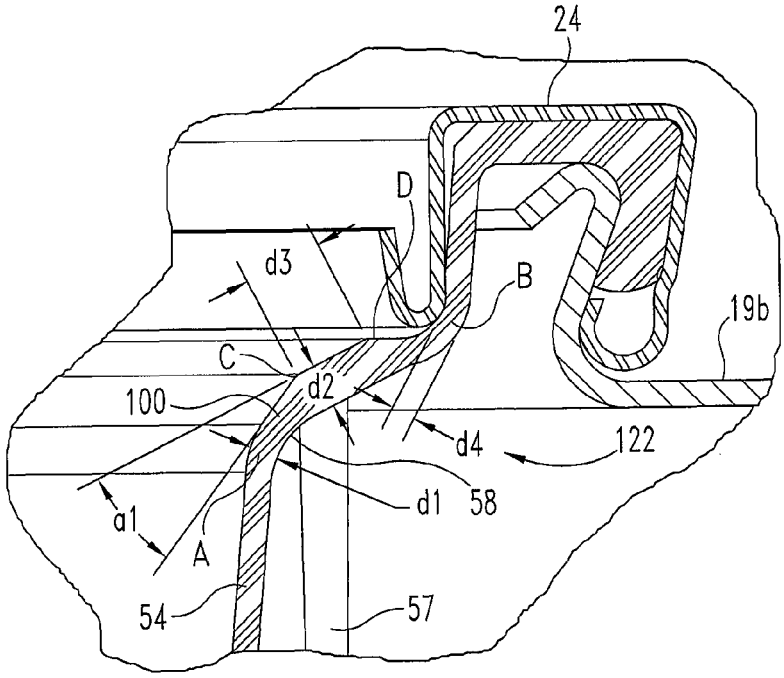
FIG. 12 is a partial front elevational view, in full section, of an enlarged detail of one thicker band portion of the disclosed closure bodies.

Referring now to FIGS. 8A-10B, closure assembly 120 includes a single thicker wall portion identified as band 122 that is located at or at least adjacent fold 58 and generally coincides with the location where the venting ears 57 are positioned. Closure assembly 220 includes a second thicker wall portion identified as band 222 that is located at or at least closely adjacent to invertible fold 48. Band 222 is essentially of the same construction as band 122. Closure assembly 220 thus includes two thicker wall portions or bands 122 and 222 that are spaced-apart from each other. Each thicker wall portion or band 122 and 222 is annular in shape, consistent with the annular form and shaping of the entire closure assembly. Closure assembly 320 includes a single thicker wall portion identified as band 322 that is located in a different location than the single band 122 of closure assembly 120. Band 3222 is essentially the same as band 222 in construction and location. The geometry, contours, and dimensions of each thicker wall portion are illustrated in FIG. 12.

Some of the specifics will now be described using FIG. 12 and portion 122 as the representative example. The wall thickness of the frustoconical body 174 is substantially uniform until reaching the vicinity of point A. Portion 100 begins at this location and the wall thickness increases. Point A also signifies the start of bend 58. The width of portion 100 gradually increases until point C is reached and the width is generally uniform between points C and D. From point D to point B the thickness gradually decreases. Thickness dimension d1 is approximately 0.025 inches (0.635 mm) at the bend (Point A). Thickness dimension d2 is approximately 0.041 inches (1.041 mm) between Points C and D. Length dimension d3 is approximately 0.075 inches (1.905 mm). Thickness dimension d4 at Point B is approximately 0.023 inches (0.584 mm). Angle a1 measures approximately 30 degrees. Point A generally coincides with a concave bend in section 54 or at least the start of the bend, as viewed from the exterior of the closure body 22. Point B generally coincides with a convex bend in section 54.

Figure 11:
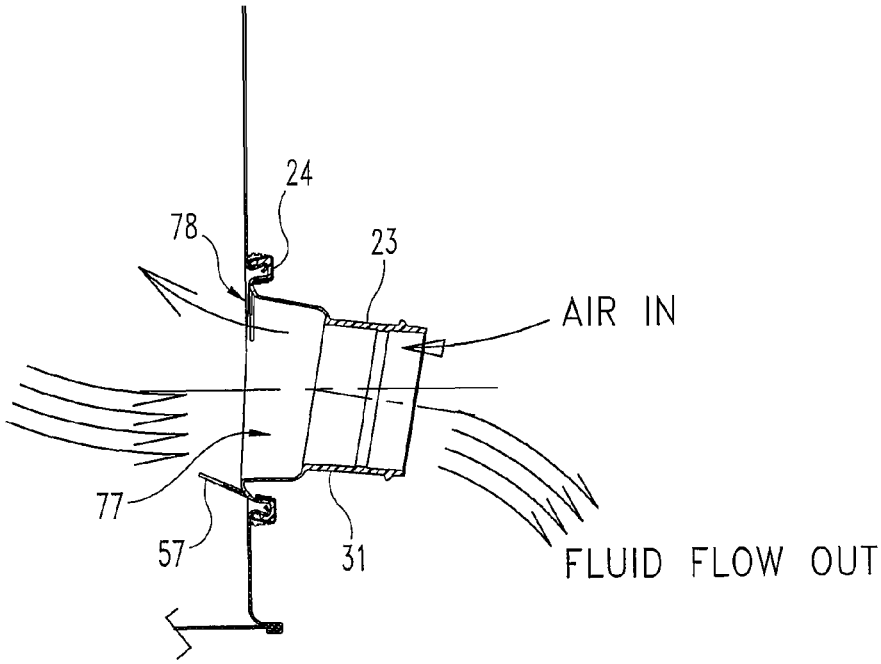
FIG. 11 is a diagrammatic side elevational view, in full section, showing a deflected closure body in a fluid dispensing orientation with entering air flow.

With continued reference to FIGS. 8A, 8B, 11 and 12, closure assembly 120 is described in greater detail. The area or portion of the frustoconical section 54 that has been referenced as fold 58 has a thicker wall for that portion 122 generally between points A and B. This thicker wall portion or band 122, by design, generally coincides with the location where the venting ears 57 are positioned. The wall thickness of band 122 is approximately twice the wall thickness of the spout portions adjacent to band 122. Band 122 permits the extended spout 31 to be flexed so as to point it in a desired dispensing direction and generally remain in that selected orientation. The principle of the mechanism is similar to a flexible drinking straw, such as those straws used in hospitals. The shape of the spout wall, including band 122, in combination with the properties of the plastic and its relative wall thickness cause the spout 31 to remain in its flexed or deflected desired orientation, as illustrated in FIG. 11. When the spout is pushed or pulled in the desired direction for dispensing, the thicker band 122 offsets stresses in the frustoconical section 54 which typically cause a symmetric extended condition. This off-setting or overriding is caused by the material strength of thicker band 122 and the adjacent material or spout body material "break-over" into a lower stress condition similar to a spiral twisted annular belt or "rubber band". To completely describe this process, the band has a near neutral stress condition when the spout is extended axially. During repositioning the spout away from the "natural" axis, a higher unstable stress condition exists in the band and adjacent areas. As the spout is redirected further, it passes through a break-over condition and the stress again stabilizes in a lower neutral condition. This condition is a three dimensional stress condition similar to common two dimensional self-closing plastic hinge designs which orient in either the open or closed position and will not maintain or stabilize in a partially open or closed position. Considering the principles of elastic and plastic deformation and set, it will be noted that the redirected, near neutral, axis registers to the side of the spout, due to this deflection, off of the axial centerline 59. The end user, prior to dispensing contents from the container, simply needs to manually push the spout 31 in the desired direction for dispensing and the construction and arrangement of that thicker section, considering the overall geometry and the type of plastic as well as the thicker wall, causes the spout to remain in that selected orientation.

As used herein, the reference to "deflection" means that the spout or the portion or section of the spout that is being deflected into a desired or selected dispensing orientation will generally stay in that orientation until moved manually to another orientation. The branding terminology that has been adopted for the thicker wall portion 76 is "memory band". The "deflection" moves the axial centerline of the spout from a generally vertical orientation into something which is off of vertical.

There is a benefit to be realized from simply being able to direct the spout 31 and have it maintain that selected orientation. By remaining in the desired (selected) orientation for dispensing contents from the container, the end user can control the dispensing direction. An added benefit is realized when the closure body associated with the "directional" spout 31 is configured with the illustrated and disclosed venting ears 57. When the spout 31 is extended, the ears 57 flip from vertical to horizontal and cooperate to define central flow opening 77 and a plurality of outward vent openings 78. This basic venting concept or design is disclosed in U.S. Pat. No. 4,618,078, issued Oct. 12, 1996, to Hamman et al.

Figure 8A:
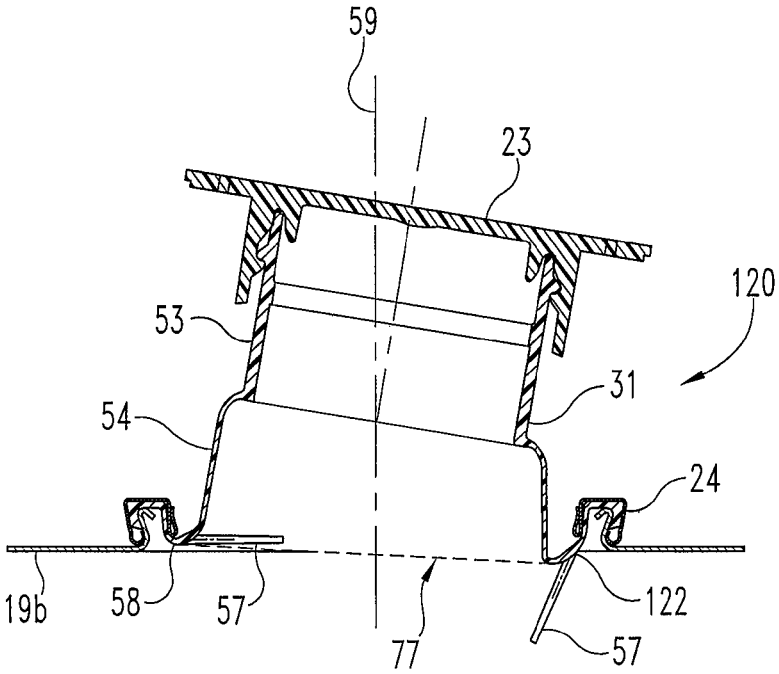
FIG. 8A is a front elevational view, in full section, of the FIG. 1 closure body flexed into a desired orientation for dispensing of the container contents.
Figure 8B:
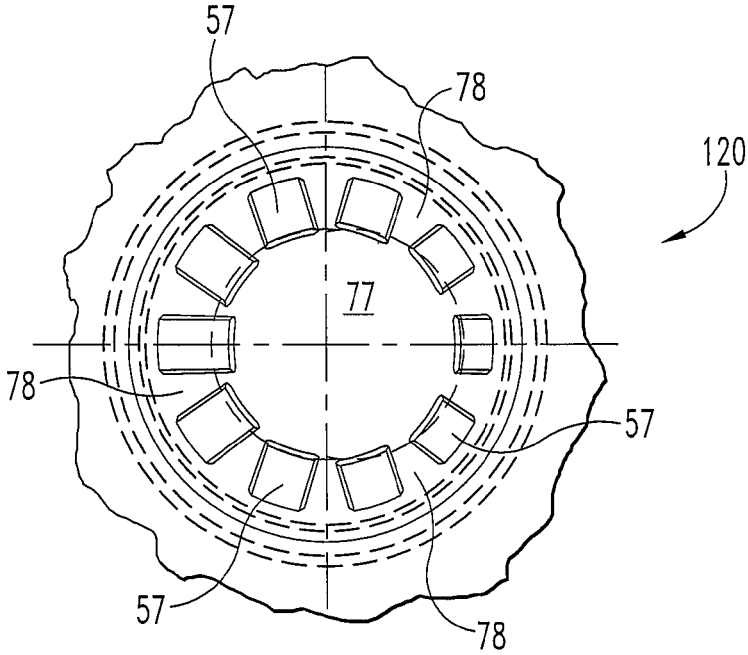
FIG. 8B is a bottom plan view of the FIG. 8A closure body showing the orientation of the venting ears when the spout is extended and flexed into the desired orientation.
Figure 9A:
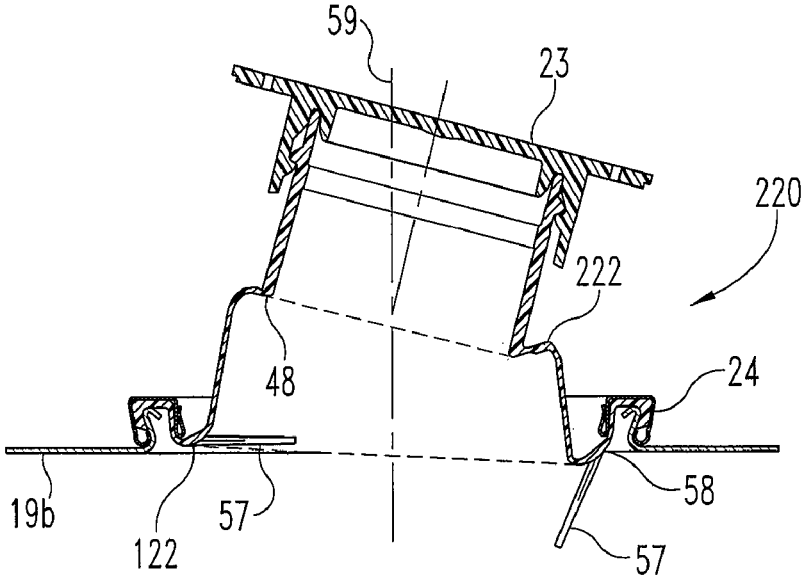
FIG. 9A is a front elevational view, in full section, of an alternative closure body flexed into a desired orientation for dispensing of the container contents.
Figure 9B:
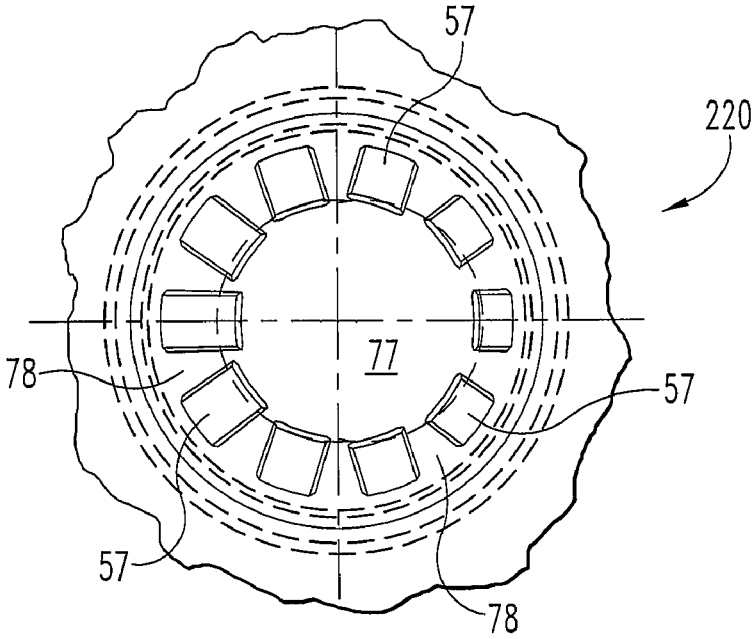
FIG. 9B is a bottom plan view of the FIG. 9A closure body showing the orientation of the venting ears when the spout is extended and flexed into the desired orientation.

When the spout 31 is flexed in a direction to achieve a desired orientation, see FIGS. 8A, 8B and 11, some of the venting ears 57, specifically those closest to the direction of flexing, move from horizontal in the direction of vertical, but do not achieve a complete vertical orientation. The extent or degree of travel towards the vertical orientation is controlled by the amount or degree of flexing of spout 31, pivoting at thicker wall portion 122. As some of the venting ears pivot back towards vertical, the size and shape of central flow opening 77 changes. The cross sectional area increases and the generally circular shape becomes more oval, though only slightly, see FIG. 8B. The vent opening 78 on the side with the deflected venting ears opens up, but pouring from that side does not require venting. Before dispensing could occur from any direction and thus vent openings had to be provided around the entire central flow opening 77. Now that the flow is directional, only vent openings on the opposite or top side are required for "anti-glug" dispensing.

With continued reference to FIG. 11, it will be seen that flow out of the lower half of the spout 31 does not require vent openings 78 on that same side. So long as vent openings 78 are provided above the exiting flow, i.e., on the opposite side of the spout 31, the dispensing flow will not glug. While all of the benefits of using a closure assembly with venting ears are still achieved by the present invention, the added benefit of smoother and faster exiting (i.e., dispensing) flow is provided by manipulation of the venting ears and having a central flow opening with a larger cross sectional area.

Figure 10A:
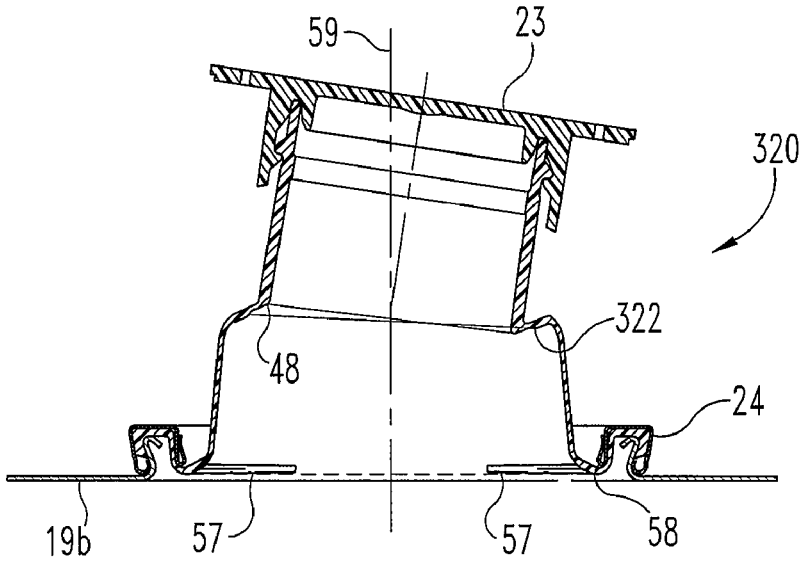
FIG. 10A is a front elevational view, in full section, of another alternative closure body flexed into a desired orientation for dispensing of the container contents.
Figure 10B:
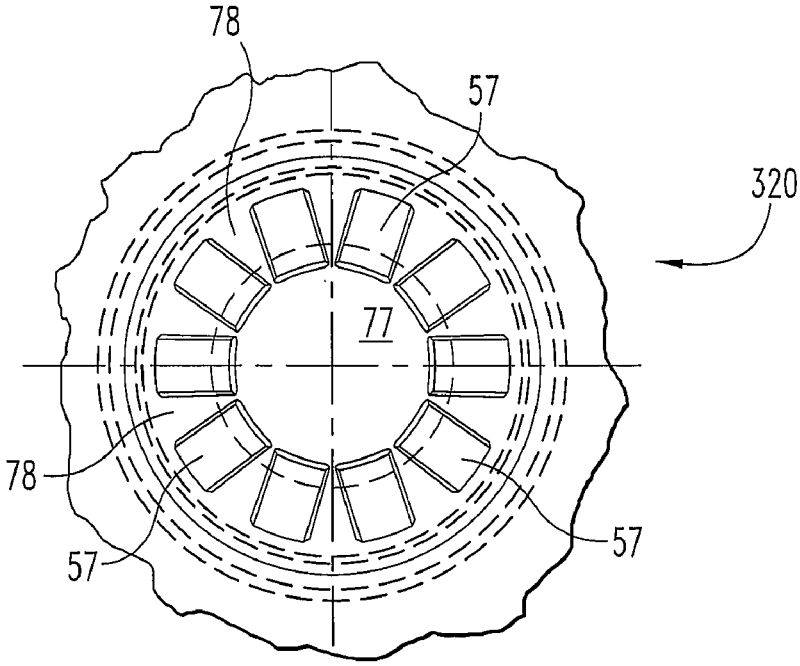
FIG. 10B is a bottom plan view of the FIG. 10A closure body showing the orientation of the venting ears when the spout is extended and flexed into the desired orientation.

The closure assemblies of FIGS. 9A, 9B, 10A, and 10B are essentially the same as closure assembly 120 in terms of the use of venting ears 57. The intended differences for these three closure assemblies 120, 220, and 320 are limited to the number of thicker bands being used and where those thicker bands are positioned. In the illustrations of FIGS. 10A and 10B, there is no venting ear 57 movement due to the deflection of the spout. This difference in terms of the lack of movement of venting ears 57 is due to the fact that closure assembly 320 does not have a thicker band positioned at the fold 58 location. Accordingly, as the spout is deflected about invertible fold 48, any effects on venting ears 57 located at fold 58 are negligible.

With continued reference to FIG. 1, the configuration of venting ears 57 in the nested orientation of spout 29 (as a generic representation) reveals that each venting ear 57 extends in a downward or depending direction with a noticeable clearance space 90 between adjacent venting ears 57. Each clearance space 90 has a slight upward taper due to the slight downward taper of each venting ear 57. Each clearance space 90 is substantially the same and results automatically based on the width and shaping of each venting ear 57 and the number of venting ears selected. The width of each venting ear and the number of ears cooperate so as to preclude any "noticeable contact" between adjacent venting ears when the corresponding spout is extended. As used herein and as defined, "noticeable contact" means contact between adjacent venting ears which is designed to occur based on the number and size of the venting ears 57. Typical of prior art structures, the venting ear corners overlap, by design. With the present disclosure, such contact is designed not to occur and thus, when the spout is extended, there is no noticeable contact between adjacent venting ears 57. Since the spout is molded from plastic and since there is some degree of flexibility, manual alteration or reshaping could cause the edges of adjacent venting ears to perhaps touch slightly. This touching contact is not considered to be "noticeable".

Each venting ear 57 has a polyethylene body and is unitarily molded as part of each closure body. The base 91 of each venting ear is joined with the closure body at the location of fold 58. As the fold 58 inverts or flips at the time of spout extension (see FIGS. 6, 7, and 8A-10B), the venting ears initially flip to a generally horizontal orientation. The radiating pattern as illustrated in FIG. 7 shows that the inner edges 92 define an inner opening 77 for flow exit of the container contents. The spaces 90 between adjacent venting ears 57 provide the venting capability for the inflow of air as vent opening 78. In the preferred embodiment, each venting ear is approximately 0.05 inches (1.270 mm) thick, approximately 0.36 inches (9.144 mm) wide (at its widest point), and approximately 0.48 inches (12.192 mm) long. There are ten (10) venting ears used for a closure assembly that is designed for a standard 2⅜ inch (63 mm) opening. The length, width, and number of venting ears have to be considered so that there will be some degree of definition to the flow opening, venting passageways, and the avoidance of any noticeable contact between adjacent venting ears. If the number of venting ears is too few, based on a selected width, then the flow opening will not be well defined. Increasing the length of each venting ear would help to some extent, but this could result in a well-defined flow opening that is too small for effective discharge of the container contents.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A closure assembly for a container comprising:

a closure body having a first section, a cooperating second section, and an invertible fold positioned between said two sections, said closure body being constructed and arranged to be oriented in either a nested condition or an extended condition, said first section defining an outlet opening;

a closing cap constructed and arranged for assembly to a spout portion of said closure body for closing off said outlet opening;

means for assembling said closure body to a container outlet wall which defines an opening; and a plurality of venting ears joined to said second section in an annular array, said venting ears being sized, constructed, and arranged to be spaced-apart without any contact between adjacent venting ears when said closure body is oriented in said extended condition.

2. The closure assembly of claim 1 wherein said plurality of venting ears comprises a total of ten venting ears.

3. The closure assembly of claim 2 wherein each venting ear has a length dimension of approximately 0.48 inches (12.192 mm).

4. The closure assembly of claim 3 wherein each venting ear has a width dimension of approximately 0.36 inches (9.144 mm).

5. The closure assembly of claim 2 wherein each venting ear has a width dimension of approximately 0.36 inches (9.144 mm).

6. The closure assembly of claim 1 wherein said closure body includes a first thicker wall portion adjacent said invertible fold, said first thicker wall portion being constructed and arranged as a memory band for managing off-of-vertical deflection of said spout portion.

7. The closure assembly of claim 6 wherein said closure body includes a second thicker wall portion adjacent said container outlet, said second thicker wall portion being constructed and arranged as a memory band for managing off-of-vertical deflection of said spout portion.

8. The closure assembly of claim 7 wherein said plurality of venting ears comprises a total of ten venting ears.

9. The closure assembly of claim 8 wherein each venting ear has a length dimension of approximately 0.48 inches (12.192 mm).

10. The closure assembly of claim 9 wherein each venting ear has a width dimension of approximately 0.36 inches (9.144 mm).

11. The closure assembly of claim 8 wherein each venting ear has a width dimension of approximately 0.36 inches (9.144 mm).

12. The closure assembly of claim 1 wherein said closing cap includes a substantially planar upper lip and a pair of bail handles.

13. The closure assembly of claim 12 wherein each bail handle includes an outwardly projecting lift tab.

14. The closure assembly of claim 13 wherein each lift tab is spaced apart from said means for assembling.

* * * * *